US008083394B2

(12) United States Patent
Fischer et al.

(10) Patent No.: US 8,083,394 B2
(45) Date of Patent: Dec. 27, 2011

(54) CONCRETE WASH AND RECOVERY SYSTEM

(75) Inventors: Peter W. Fischer, Apple Valley, MN (US); Jeffery R. Miller, Cannon Falls, MN (US); Patrick N. Jay, Farmington, MN (US)

(73) Assignee: AVR, Inc., Apple Valley, MN (US)

( * ) Notice: Subject to any disclaimer, the term of this patent is extended or adjusted under 35 U.S.C. 154(b) by 345 days.

(21) Appl. No.: 12/203,594

(22) Filed: Sep. 3, 2008

(65) Prior Publication Data

US 2010/0051062 A1 Mar. 4, 2010

(51) Int. Cl.
*B28C 7/16* (2006.01)

(52) U.S. Cl. ..... 366/41; 366/54; 366/68

(58) Field of Classification Search ..... 134/23; 366/41, 54, 68

See application file for complete search history.

(56) References Cited

U.S. PATENT DOCUMENTS

| | | | | |
|---|---|---|---|---|
| 3,112,100 | A | 11/1963 | Pritchard | |
| 3,246,884 | A | 4/1966 | Pritchard et al. | |
| 4,314,709 | A | 2/1982 | Silbernagel | |
| 5,009,508 | A | 4/1991 | Wojdylo | |
| 5,433,519 | A | 7/1995 | Irsch | |
| 5,741,065 | A | 4/1998 | Bell et al. | |
| 6,039,468 | A * | 3/2000 | Kowalcyzk | 366/41 |
| 6,155,277 | A | 12/2000 | Barry | |
| 6,418,948 | B1 | 7/2002 | Harmon | |
| 6,782,925 | B2 * | 8/2004 | Raposo et al. | 141/5 |
| 6,866,047 | B1 | 3/2005 | Marvin | |
| 7,117,995 | B2 | 10/2006 | Connard, III | |
| 7,147,360 | B2 * | 12/2006 | Elefsrud | 366/26 |
| 2003/0202418 | A1 * | 10/2003 | Scartezina | 366/44 |
| 2006/0000490 | A1 | 1/2006 | Barragan et al. | |
| 2007/0256707 | A1 | 11/2007 | Leonardich et al. | |

OTHER PUBLICATIONS

Enviroguard, http://www.enviroguard.ca/index.html (last visited Jun. 1, 2009).

Raider Resources, Inc., http://www.envirochute.com/pdf/Brochure.pdf (last visited Jun. 1, 2009).

Green Vision Partners, http://washoutsolutions.com/srs-washout-system.htm (last visited Jun. 1, 2009).

Concrete Slurry Solutions, http://www.concreteslurrysolutions.com/ (last visited Jun. 1, 2009).

* cited by examiner

*Primary Examiner* — Michael Kornakov
*Assistant Examiner* — Douglas Lee
(74) *Attorney, Agent, or Firm* — Haugen Law Firm PLLP; Frederick W. Niebuhr

(57) ABSTRACT

A system for recovering concrete wash product includes a support frame mounted pivotally to a chassis of a transit concrete mixing vehicle, and a container mounted to the frame for arcuate movement with the frame, between a collecting position with the container disposed below a discharge chute of the vehicle, and a dispensing position with the container disposed adjacent an opening of a mixing drum of the vehicle. The container initially is placed in the collecting position to receive concrete wash product from the discharge chute by gravity as the chute is cleaned with water. After cleaning, the frame is pivoted to raise the container to the dispensing position, and a valve is opened to allow the concrete wash product to flow from the container into the mixing drum by gravity. In vehicles equipped with booster axle systems, the booster axle frame supports and positions the container, and also supports and positions the booster wheel/axle assembly.

10 Claims, 7 Drawing Sheets

CONCRETE WASH AND RECOVERY SYSTEM

BACKGROUND OF THE INVENTION

The present invention relates to recovery of the wash product generated when cleaning discharge chutes and other concrete dispensing equipment, and more particularly to wash product containment and recycling devices installed or retrofit to transit concrete mixers.

Major concrete installations typically employ transit concrete mixing vehicles, also known as concrete mixers or trucks, to deliver loads of concrete from a concrete production facility to the construction site. The trucks have rotating drums that mix the concrete during transit, so that the concrete is thoroughly mixed and ready for dispensing when the truck reaches the site. After dispensing, a concrete residue remains on the discharge chutes, hoppers, and tools such as shovels and trowels used to handle, guide, and shape the concrete. To prevent the residue from hardening, these components are cleaned on site, typically by rinsing them with water. The resulting residue of this cleaning, i.e. concrete wash product, includes water, dissolved cementatious materials, suspended fine particulates, and larger aggregate. The water is highly alkaline due to the dissolved materials, and consequently is considered a potential groundwater contaminant. Thus, the previous practice of simply dumping concrete wash product onto the ground at the construction site is generally prohibited by local ordinance, state statutes, or regulations.

A variety of systems and devices have been proposed to address the heightened environmental concern. For example, U.S. Pat. No. 7,117,995 (Connard, III), U.S. Pat. No. 7,147,360 (Elefsrud), and U.S. Patent Application Publication No, 2006/0000490 (Barragan et al.) disclose concrete mixing trucks equipped with containers for collecting the concrete wash product generated as discharge chutes and other components are rinsed.

Several of the systems involve returning the residue to the mixing drum. In U.S. Pat. No. 6,155,277 (Barry) and U.S. Pat. No. 6,866,047 (Marvin), a pump is used to transfer collected concrete wash product back into the drum. U.S. Pat. No. 6,039,468 (Kowalcyzk) shows a system in which a washout bucket mounted on a catwalk during transit is placed under the discharge chute during cleaning. After cleaning, the bucket is removably mounted to the booster axle frame, to be lifted by the frame to dump its contents into the mixing drum. In U.S. Pat. No. 5,741,065 (Bell et al.), a canister is placed below the discharge chute during cleaning. After cleaning, the canister is attached to an upright rail mounted to the mixing truck, then lifted upwardly along the rail until the canister is tilted to empty its contents into the drum.

Although these approaches are useful for avoiding groundwater contamination, they raise problems which to date have not been satisfactorily addressed. The removably mounted containers are difficult to maneuver due to their bulk and weight, especially when filled with concrete wash product. They are inconvenient, due to the need to attach and later detach the container from the rail, the booster axle frame, or other mechanism used to lift the container to a height sufficient for emptying its contents into the mixing drum. Time is required to remove the container from the fixture that supports it during transit from the concrete plant to the construction site, and further time is lost reattaching the container to the fixture after returning its contents to the mixing drum.

Some systems attempt to counteract these problems by permanently mounting the container to the mixing truck chassis. These systems rely on pumps or air pressure to lift the concrete wash product from the container into the drum, and neither approach is particularly reliable in cold weather. The alternative is to haul the collected concrete wash product back to the concrete plant for disposal or other handling.

Systems that recover concrete wash product and return it to the mixing drum advantageously reduce the risk of groundwater contamination while facilitating reuse of a product that otherwise goes to waste. However, if the content of the mixing drum is not taken into account at the concrete plant when the constituents of the next batch are loaded into the drum, there is a risk of unintentional and undesirable alteration of constituent ratios.

Therefore, the present invention has several aspects directed to one or more of the following objects:

- to provide a container for collecting concrete wash product, mounted to a transit concrete mixer through a mechanism suitable for supporting the container in transit operable to alternatively lower the container for collecting concrete wash product and raise the container for returning collected wash product to the mixing drum;
- to provide a device for mounting a container to a booster axle frame of a transit concrete mixer such that the usual pivoting of the booster axle frame moves the container between a wash product collecting position and a wash product dispensing position;
- to provide a process for the recovery of concrete wash product by gravity, and the return of collected wash product by gravity to a mixing drum of a transit concrete mixer for reuse, without manually lifting, mounting, dismounting, or otherwise handling the container used for such recovery and return; and
- to provide a device for measuring concrete wash product collected in a container while cleaning the discharge chute and other concrete dispensing components.

SUMMARY OF THE INVENTION

To achieve these and other objects, there is provided a system for reclaiming concrete wash residue. The system includes a support frame adapted for a rotational coupling to a chassis of a transit concrete mixing vehicle, to pivotally raise and lower the frame relative to the chassis. The system further includes a container mounted to the frame for arcuate movement alternatively toward a dispensing position and toward a collecting position as the frame is raised and lowered, respectively. The container further is configured to be carried by the frame as the vehicle travels between concrete production facilities and construction sites. When in the collecting position, the container is disposed below a discharge chute of the vehicle to enable and facilitate a transfer of concrete wash product from the chute to the container by gravity. When in the dispensing position, the container is disposed adjacent an opening of a mixing drum of the vehicle to enable and facilitate a transfer of concrete wash product from a container to the mixing drum by gravity.

Regardless of whether the system is in use or the vehicle is in transit, the container remains mounted to the support frame. The container is mounted to the frame in a manner that is highly stable and secure, and permanent if desired. The container can be moved between its collecting and dispensing positions merely by lowering and raising the support frame. There is no need to remove the container from an "in transit" mounting.

The ability to raise and lower the container solely by manipulating the frame eliminates the need for direct handling of the container. Further, it allows the concrete wash product to be collected and later dispensed, solely by gravity. As compared to earlier systems using pumps or pressurized air to convey the wash product, the present system is simpler, less costly, and more reliable.

In a preferred approach, the container is mounted to pivot relative to the support frame about an axis disposed above the container's center of mass. This tends to maintain the container in a desired upright orientation, regardless of the angular position of the support frame. In this case the container is provided with a top intake passage for receiving concrete wash product and a bottom outlet passage for dispensing the concrete wash product.

Another aspect of the present invention is a device for collecting and recycling concrete wash product. The device includes an elongate container adapted to receive and hold concrete wash product. A mounting arrangement secures the container to a booster axle frame of a transit concrete mixing vehicle. The booster axle frame is coupled to pivot about a transverse pivot axis relative to a chassis of the vehicle. The mounting arrangement is adapted to orient the container in a lengthwise and transverse extension between opposite side arms of the booster axle frame, for carriage by the frame in transit as the vehicle travels between concrete production facilities and construction sites. The mounting arrangement further supports the container for arcuate movement as the booster axle frame pivots, between a collecting position corresponding to a lowered frame in which the container is disposed below a discharge chute of the vehicle to enable a transfer of concrete wash product from the chute to the container by gravity, and a dispensing position corresponding to a raised booster axle frame in which the container is disposed near an opening of a mixing drum of the vehicle to enable a transfer of concrete wash product from the container to the mixing drum by gravity.

The device is especially well suited as a retrofit for concrete transit mixers already equipped with booster axle assemblies. The container extends lengthwise transversely (the longitudinal direction being lengthwise of the vehicle) between opposite side arms of the booster axle frame, and remains in position during transit and use. Thus, the same pivotal movement of the booster axle frame that carries the booster wheels between their ground engaging position and their raised storage position also moves the container between its wash product collecting and dispensing positions.

A preferred device further includes a receptacle removably mounted to a lower end of the discharge chute of the mixer to receive concrete wash product generated as the chute is cleaned, and a conduit adapted to carry the concrete wash product from the receptacle to an intake opening of the container. A filtering component can be disposed along the intake opening to remove larger diameter aggregate from the concrete wash product on its way into the container. The container further can be equipped with an outlet passage for conducting the concrete wash product from the container into the mixing drum. A flow control mechanism is provided for selectively opening and closing the passage.

Another aspect of the present invention is a process for recovering concrete wash product at a construction site. The process includes:

(a) supporting a container with respect to a chassis of a transit concrete mixing vehicle through a frame mounted pivotally to the chassis, for accurate movement as the frame pivots;

(b) pivoting the frame to a lowered position to locate the container below a discharge chute of the vehicle; and (c) with the container located below the chute, washing the chute and causing the resulting concrete wash product to flow by gravity from the chute into the container to collect the concrete wash product in the container.

The process can entail reuse of the recovered concrete wash product. In particular, after cleaning the chute and collecting the concrete wash product, the frame is pivoted to a raised position to locate the container near an opening of a mixing drum of the vehicle. Then, the concrete wash product is caused to flow from the container through the opening into the drum by gravity.

In transit concrete mixing vehicles equipped with booster axle assemblies, it is particularly advantageous to support the container through the booster axle frame. In these arrangements, lowering the booster axle frame to cause the booster wheels to engage the ground also moves the container into the collecting position. Conversely, raising the booster axle frame to place the wheels in a raised, stowage position also raises the container to the dispensing position. The dual-purpose use of the booster axle frame eliminates the need to provide a separate frame for supporting the container.

Thus, in accordance with the present invention, concrete wash product generated by on-site cleaning of concrete dispensing equipment not only is contained against runoff onto the ground, but also is returned to the mixing drum of the concrete truck for reuse as part of a subsequent load of concrete. A single container is located below the discharge chute of the mixer to collect the wash product as the chute is cleaned, then raised to a dispensing location to return collected wash product to the mixing drum. This is accomplished entirely by a frame preferably a booster axle frame, mounted pivotally to the vehicle chassis. The wash product is collected and later dispensed solely by gravity, resulting in a simpler, lower cost and more reliable system. Finally, the mechanism that mounts the container to the frame supports the container not only during use (recovering and returning concrete wash product to the mixing drum), but also in transit. A vehicle operator can deliver a series of concrete loads, cleaning the chutes and other equipment on site after each delivery and then returning the concrete wash product to the mixing drum, all without mounting, dismounting, lifting, or otherwise handling the container, substantially reducing the time and effort involved in recovering and reusing concrete wash product.

IN THE DRAWINGS

For a further appreciation of the foregoing features and other advantages, reference is made to the following detailed description and to the drawings, in which.

Figure 8:
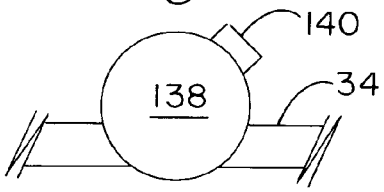
Figure 9:
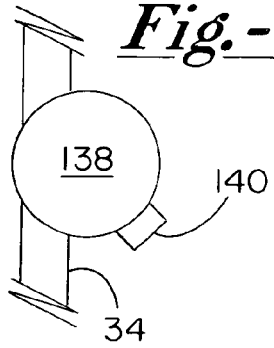
Figure 10:
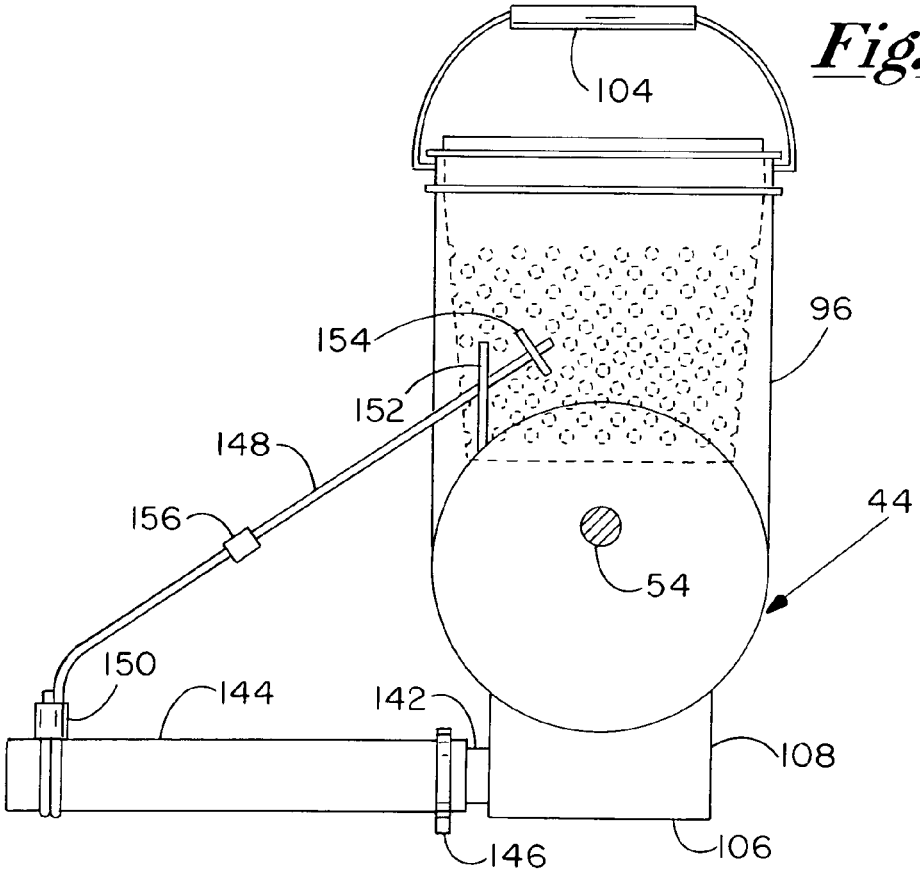
Figure 11:
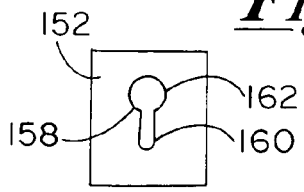

FIGS. 8 and 9 schematically illustrate an alternative embodiment container; and FIGS. 10 and 11 illustrate an alternative device for controlling liquid flow out of the container.

DETAILED DESCRIPTION OF THE PREFERRED EMBODIMENTS

Figure 1:
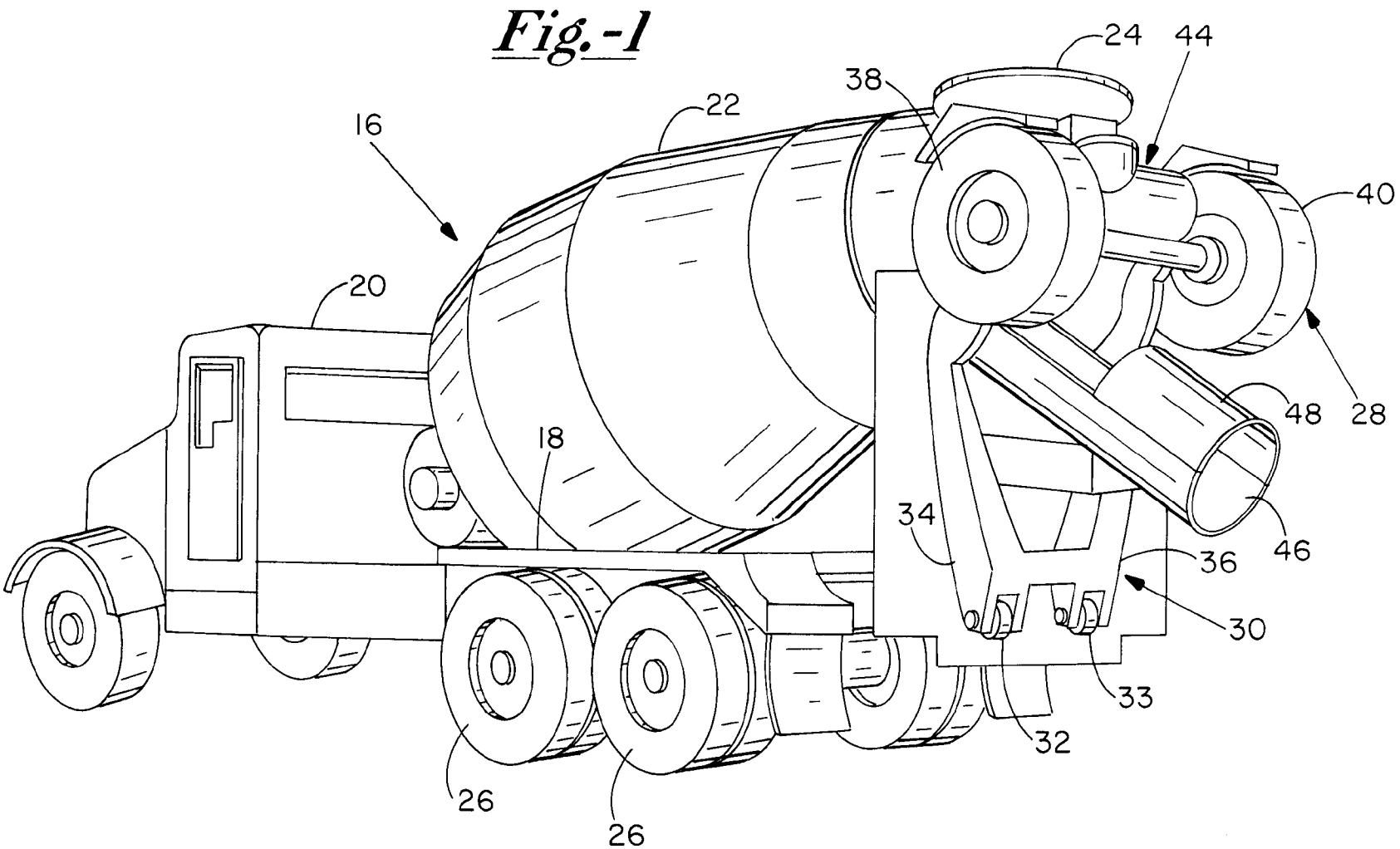
FIG. 1 is a rear perspective view of a transit concrete mixing vehicle equipped to recover and recycle concrete wash product in accordance with the present invention.
Figure 2:
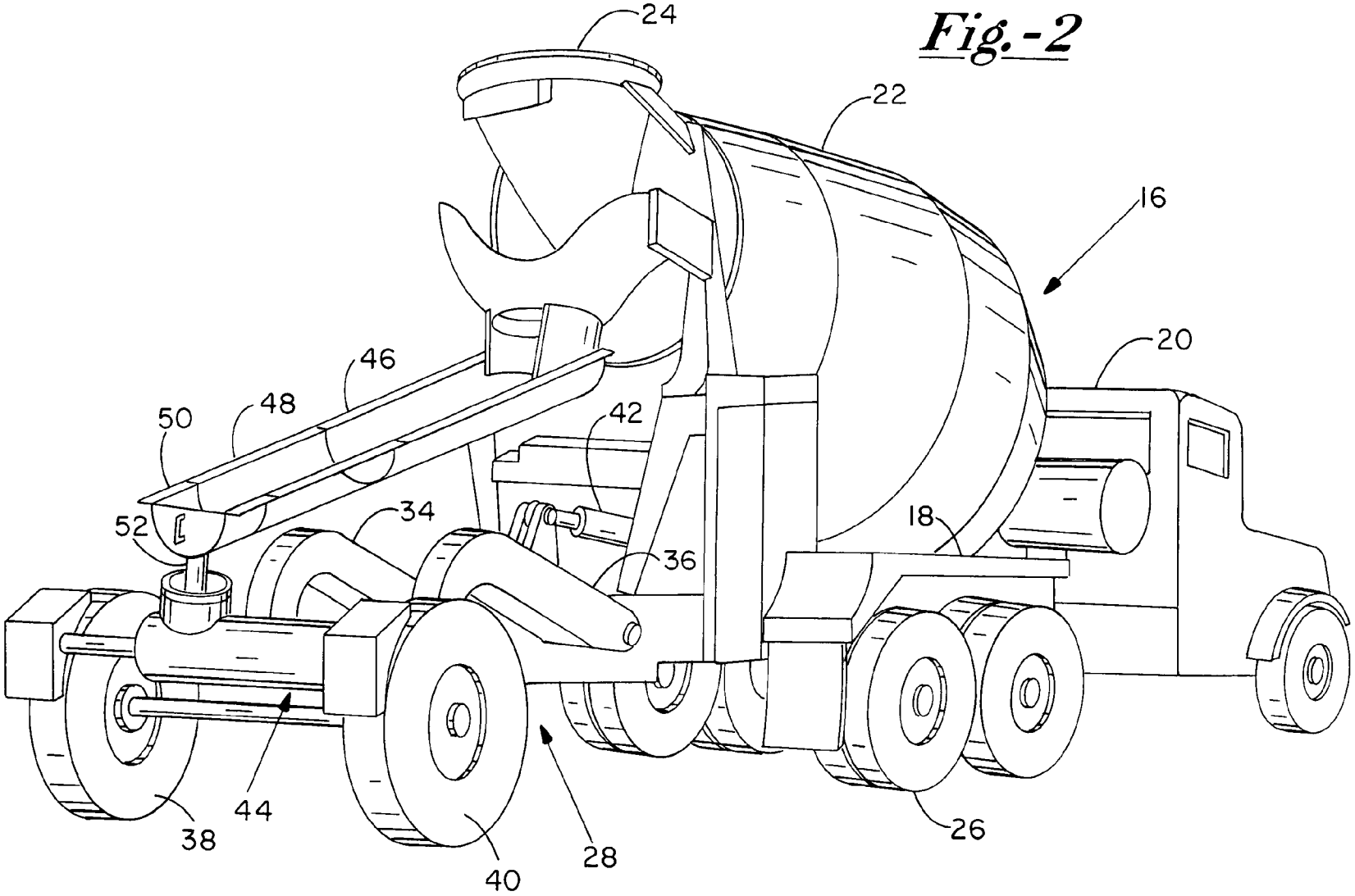
FIG. 2 is a rear perspective view showing a booster axle frame raised, rather than lowered as in FIG. 1.

Turning now to the drawings, there is shown in FIGS. 1 and 2 a transit concrete mixing vehicle 16 used to haul concrete from a production plant to a construction site. Vehicle 16 includes a main frame or chassis 18 that supports a cab 20, a mixing drum 22 mounted to rotate relative to the chassis, and a hopper 24 located behind an upper opening of the mixing drum to facilitate loading material into the drum. The chassis in turn is supported by several wheel/axle assemblies 26 located beneath the chassis.

To provide additional support for chassis 18 when the necessary or desired, vehicle 16 is equipped with an auxiliary axle or booster axle system 28. System 28 includes a booster axle frame 30 secured to chassis 18 through a pair of aligned rotational couplings 32 and 33. Frame 30 includes opposed, spaced apart booster axle frame arms 34 and 36. A proximate end of each arm is coupled to the chassis through its associated rotational coupling. A booster wheel/axle assembly including wheels 38 and 40 is supported by a region of frame 30 relatively remote from the chassis.

A hydraulic actuator 42, coupled between chassis 18 and booster axle frame 30, is retractable and extensible to alternatively raise and lower the booster axle frame between a stowage position (FIG. 1) in which frame 30 is generally upright and supports wheels 38 and 40 near hopper 24, and an operating position for transit in which the booster wheels engage the ground.

Typically, a mixing truck like vehicle 16 is supplied with constituents of concrete at a concrete plant, mixes the components by revolving the mixing drum in transit from the plant to the construction site, then delivers the concrete at the site. A given vehicle typically completes several deliveries per day, with the number of deliveries depending on a variety of factors, primarily the distance between the concrete plant and the job site. After each delivery, the discharge chutes and other equipment used to dispense the concrete must be cleaned, usually by rinsing with water. Although at one time the water and residue were simply dumped onto the ground, increased concerns about the environment have led to regulations that forbid this practice. Accordingly, vehicle 16 is equipped with a system for collecting the water and residue. Advantageously, the system also recycles the water and residue for reuse in a subsequent load of concrete.

With continued reference to FIGS. 1 and 2, the system includes an elongate container or tank 44 extending lengthwise transversely between the remote or free ends of booster axle frame arms 34 and 36. With the booster axle frame raised as in FIG. 1, tank 44 is disposed adjacent hopper 24 and an opening in mixing drum 22. Although situated below the hopper, tank 44 is above a lower portion of the mixing drum opening, so that any water and residue (wash product) contained in the tank flow from the tank into the drum by gravity. This can be thought of as a dispensing position of the tank, corresponding to the raised position of the booster axle frame.

In FIG. 2, tank 44 is shown in a collecting position, corresponding to the lowered position of the booster axle frame. The recovery system is shown configured to collect water and residue generated by cleaning a discharge chute of the vehicle, including a primary chute section 46 and a flip section 48. Additional components of the system include a chute end section 50 removeably coupled to the free end of the flip section, and a conduit 52 extended downwardly from the end section into tank 44. The end section functions as a receptacle or funnel, preventing spillage by gathering the water and residue for entry into conduit 52.

Figure 3:
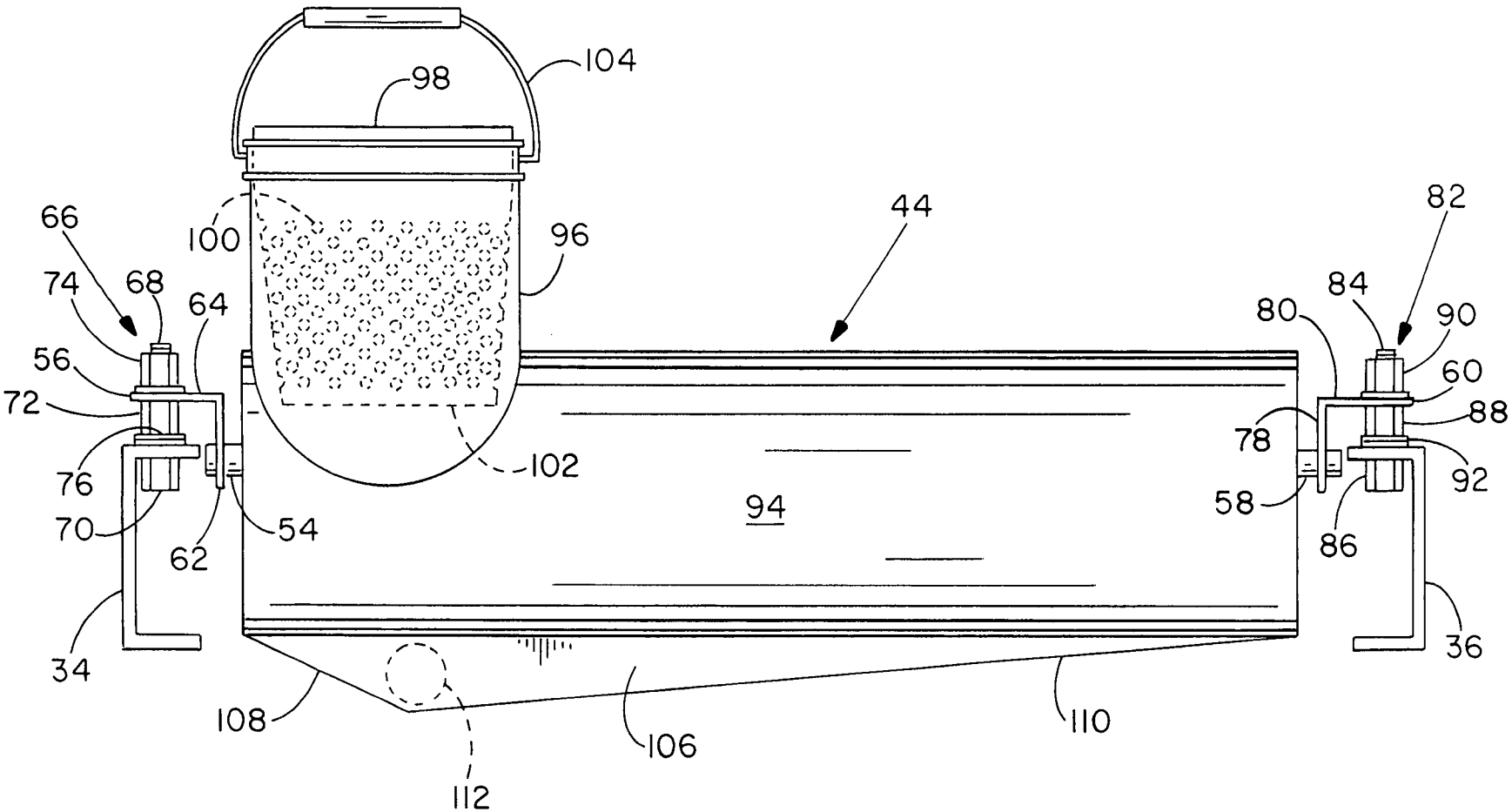
FIG. 3 is a side elevation of a container for collecting concrete wash product and a mechanism for mounting the container to the booster axle frame.
Figure 4:
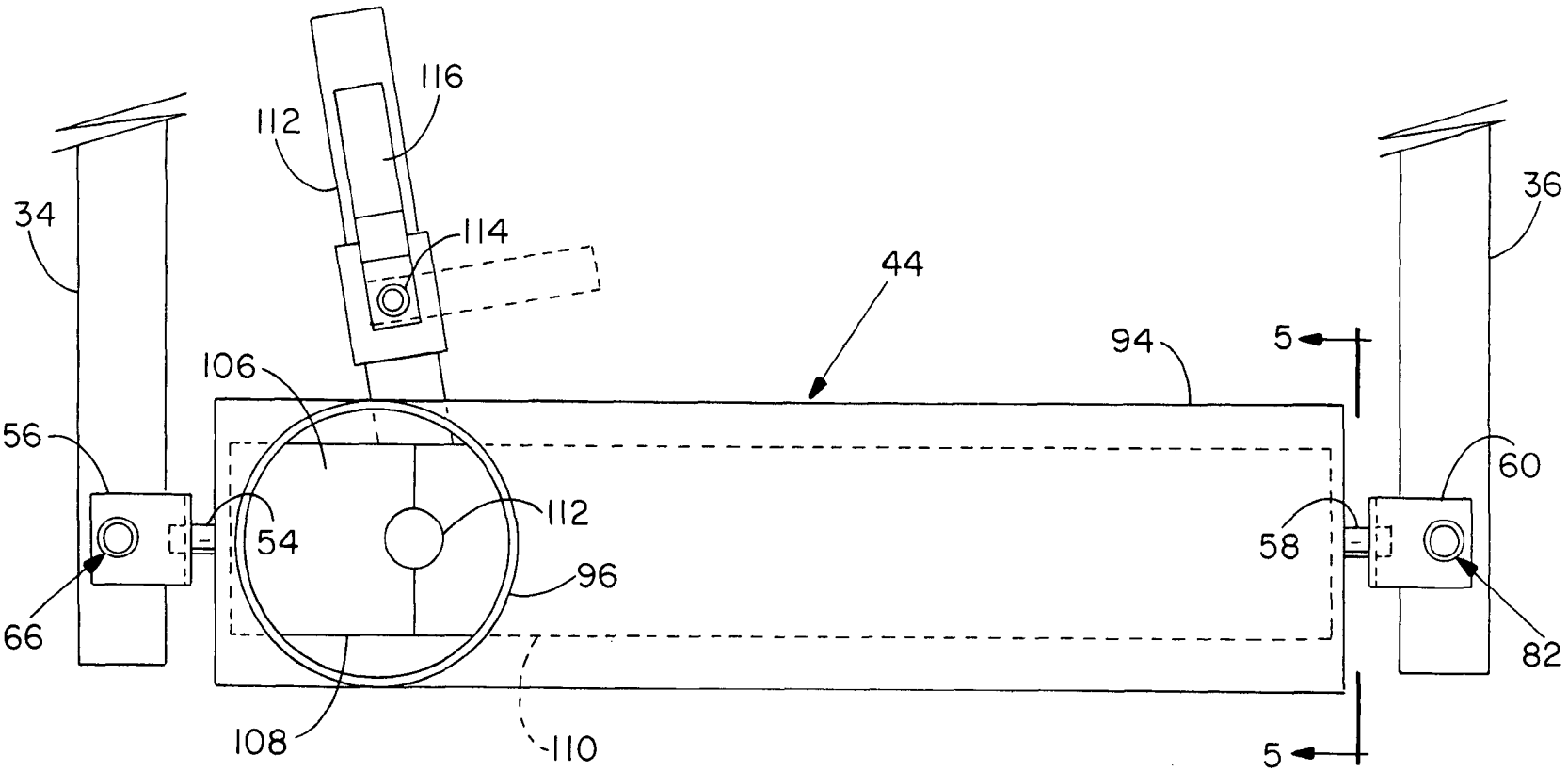
FIG. 4 is a top plan view of the container and mounting mechanism.

As seen in FIGS. 3 and 4, tank 44 is mounted to frame arms 34 and 36 through a pin 54 and mounting bracket 56 at one end of the tank, and a pin 58 and mounting bracket 60 at the other end. Pins 54 and 58 are mounted to rotate relative to their respective brackets, and are coaxial to support tank 44 for rotation about a transverse axis relative to the booster axle frame.

As seen in FIG. 3, mounting bracket 56 includes a substantially planar upright section 62 that directly supports pin 54 and a substantially planar top section 64 that is substantially horizontal when the booster axle frame is lowered. A threaded fastener 66 secures bracket 56 integrally to frame arm 34. The fastener includes an elongate externally threaded bolt 68 having a hexagonal head 70, internally threaded nuts 72 and 74, and several washers 76. With bolt 68 extended through openings in frame arm 34 and top section 64, nut 72 is tightened to fix the bolt to the frame arm, top section 64 is placed onto the bolt against nut 72, then nut 74 is tightened to fix the mounting bracket relative to the frame arm.

A substantially identical mounting arrangement is used to support tank 44 relative to frame arm 36, including bracket 60 with upright and top sections 78 and 80, and a fastener 82 including a bolt 84 with a head 86, internally threaded nuts 88 and 90 and washers 92.

Tank 44 has an elongate cylindrical main body 94. An intake passage of the tank includes an upwardly extending cylindrical neck 96 which is open at the top. A filtration device in the form of a bucket 98 is removably nested in neck 96. As shown in phantom, multiple apertures 100 are formed through an inclined side wall 102 of the bucket, and if desired are also formed through a bottom of the bucket. The device includes a handle 104 for convenient removal of the bucket from neck 96.

Bucket 98 is used to remove certain aggregate, primarily stones having diameters above a given threshold, from the water and residue entering tank 44. After collection of the water and residue, bucket 98 is removed from the neck. The larger aggregate contained in the bucket is returned to the mixing drum for reuse, dumped, or otherwise disposed of. In one version, apertures 100 are about 0.4 inches in diameter. If desired, a screen can be used in lieu of bucket 98.

Figure 5:
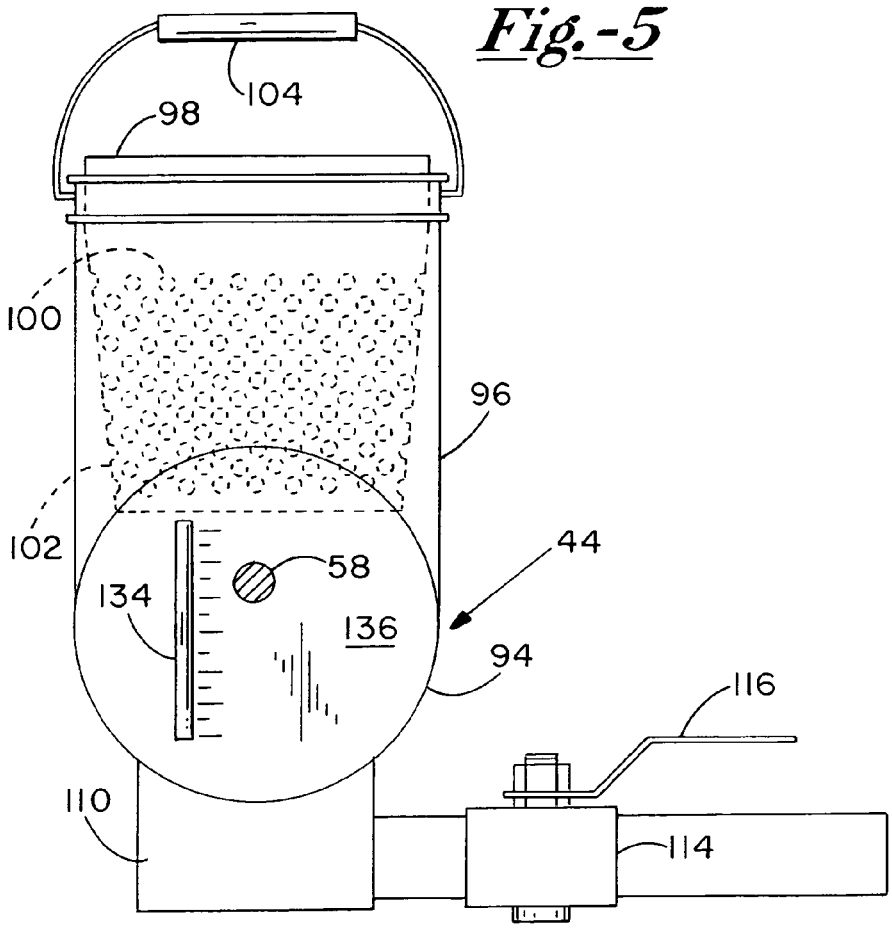
FIG. 5 is a sectional view taken along the line 5-5 in FIG. 4.

Along a bottom region 106, tank 44 is shaped to provide substantially planar bottom walls 108 and 110, inclined downwardly from opposite ends of tank to a low point or merger at an outlet passage 112. As seen in FIGS. 4 and 5, a portion of outlet passage 112 extends away from tank 44 in a generally longitudinal direction. Extended in this manner, outlet passage 112 is particularly well suited for guiding water and residue from tank 44 into mixing drum 22 when the tank is in the dispensing position. A valve 114 is disposed along passage 112. A valve handle 116 is operable between open and closed positions as shown in solid lines and broken lines, to alternatively allow and prevent fluid flow from tank 44.

As perhaps best seen in FIG. 5, pin 58 is not coaxial with a center of container 44, but is positioned above the tank center. Pin 54 is similarly situated. More importantly, the pins are located above a center of mass (i.e. center of gravity) of the container. In combination with the rotational support of the pins within their associated brackets, this ensures that tank 44 tends to remain in an upward orientation as depicted in FIG. 5, regardless of the angular position of booster axle frame 30. Whether the frame is raised as shown in FIG. 1 or lowered as in FIG. 2, Neck 96 extends upwardly from the top of tank 44.

Figure 6:
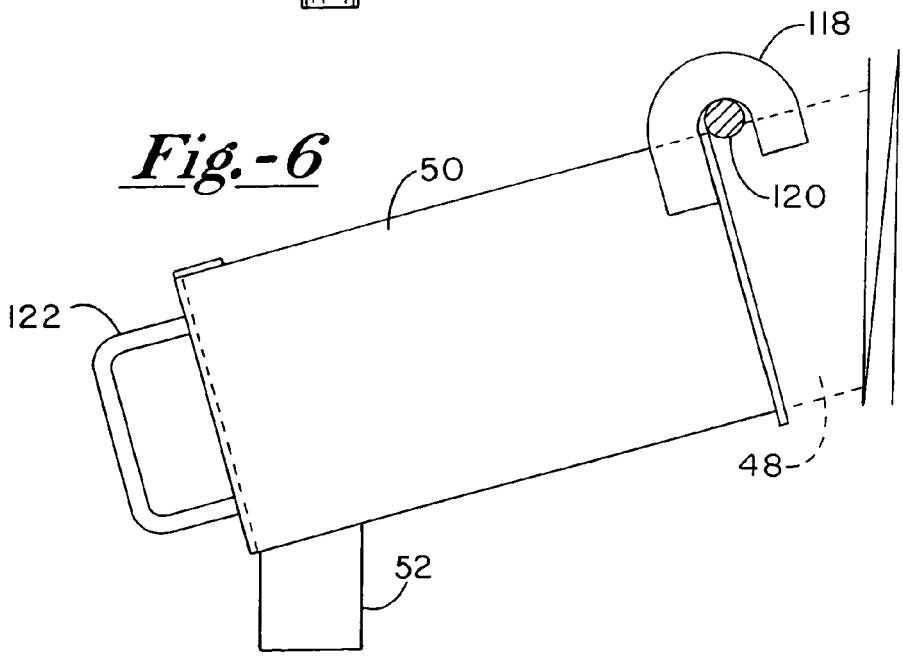
FIG. 6 is a side elevation of a receptacle coupled to a discharge chute to guide concrete wash product from the chute to the container.

FIG. 6 illustrates the removable attachment of end section 50 to the lower or free end of the discharge chute, in particular the end of flip section 48. A pair of hook members on opposite sides of end section 50, one of which is shown at 118, are supported by pins integral with the flip section, one being shown at 120. A handle 122 at one end of end section 50 affords convenient mounting and dismounting of the end section. Conduit 52, open to the end section interior, extends downwardly from a bottom wall of the end section. As best seen in FIG. 2, the curvature of end section 50 conforms to the curvature of flip section 48. End section 50 acts as a receptacle to collect water and residue flowing downwardly along the discharge chute and direct the water and residue into conduit 52.

The concrete wash product recovery system is particularly well suited for use on a vehicle equipped with a booster axle system. No auxiliary structure is required to support the container, and the booster axle frame serves the dual purpose of moving the container between the collection and dispensing positions, and moving the tag axle wheels between the ground-engaging and stowage positions. The brackets and fasteners are the only additional equipment required for mounting the container.

In a vehicle not equipped with a booster axle assembly, the container can be supported with respect to the chassis through a dedicated frame, preferably mounted to pivot relative to the chassis. With no booster wheel/axle assembly to support, such a dedicated frame can be lighter in construction because considerably less structural strength is required.

In either event, the container remains mounted to the frame through the various stages of loading, mixing, delivery, cleaning and returning to the concrete plant for reloading. None of the stages requires manual handling of the container, detachment of the container from a support fixture used in transit, or shifting the container between such a support fixture and a lifting mechanism to elevate the container and empty its contents into a mixing drum. These activities are time consuming and labor intensive, and their elimination leads to considerable cost savings and reduces the risk of injury to the operator. As noted above, a given transit concrete mixer is expected to complete several deliveries per day to a major project. The benefits afforded by the present invention increase with the frequency of deliveries.

In use, the transit concrete mixer is loaded at a concrete plant by providing water, aggregate, and cementatious components in desired ratios to the mixing drum. Rotation of the drum during transit ensures that the ingredients are mixed by the time the vehicle reaches the construction site. Assuming the booster axle is required, frame 30 is in its lowered position as shown in FIG. 2 although the discharge chute sections are in a storage configuration as shown in FIG. 1. Alternatively, if the booster axle is not required, the booster axle frame can be kept in the raised position during transit as shown in FIG. 1.

Usually, the booster axle frame is raised during delivery of the concrete because the vehicle is more maneuverable. Alternatively, the booster axle frame may be in the lowered position during delivery of the concrete. In either event, post-delivery cleaning of the discharge chute and other components is accomplished with the booster axle frame lowered. Initially, primary chute section 46 and flip section 48 are arranged as shown in FIG. 2, with end section 50 attached to the flip section and conduit 52 extending downwardly into neck 96 of the container. At this point, the main chute and flip chute are rinsed with water, typically using a hose, to remove the concrete residue. The residue and water flow into end section 50, through conduit 52 and into tank 44.

Figure 7:
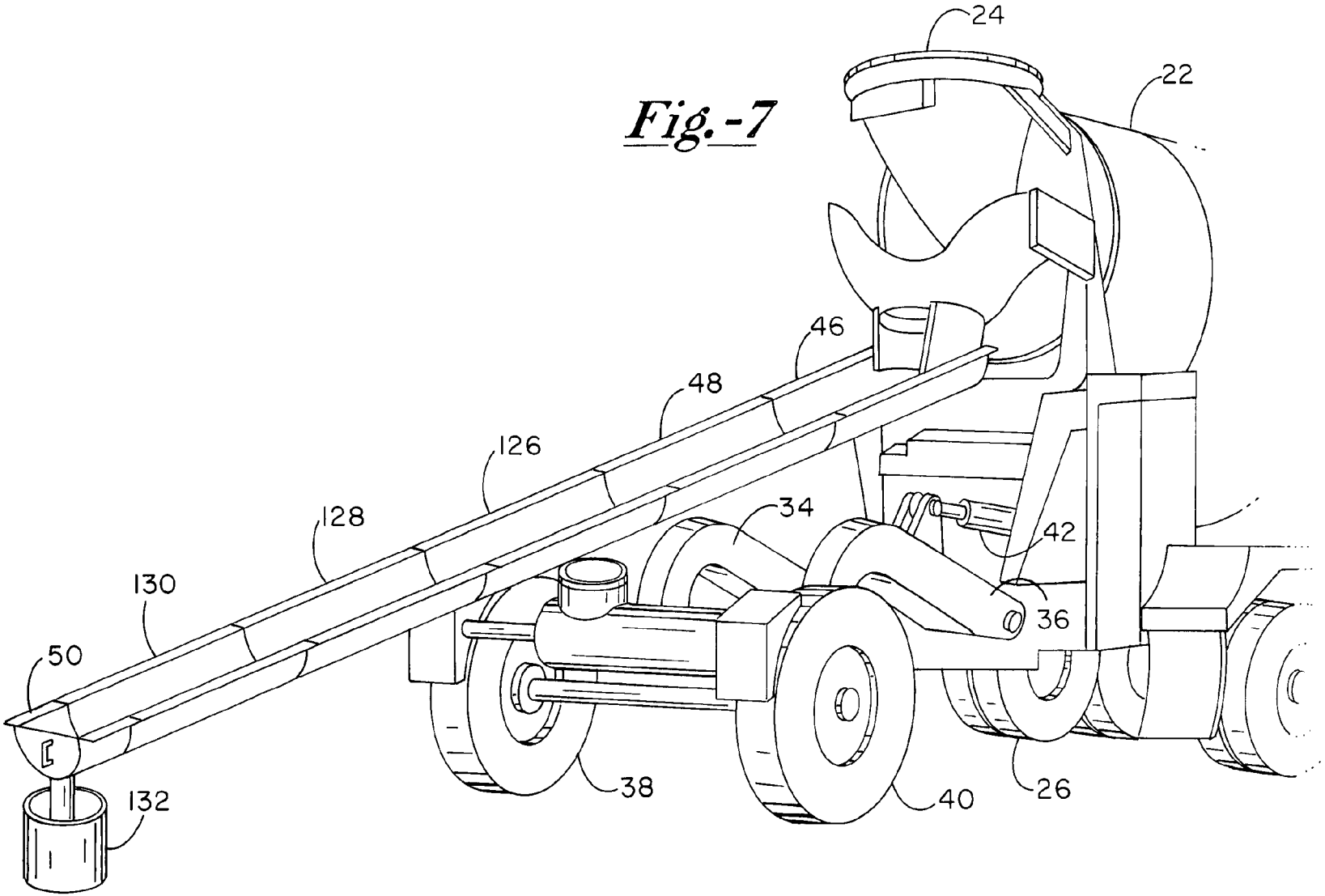
FIG. 7 is a rear perspective view of the vehicle illustrating an approach to cleaning a series of additional chute sections removably attached to lengthen the discharge chute.

Frequently, concrete is delivered and dispensed through a discharge chute extended by the addition of several accessory chute sections. An arrangement for washing an extended discharge chute is shown in FIG. 7, where accessory chute sections 126, 128 and 130 have been added to main section 46 and flip section 48 for cleaning. In this arrangement, end section 50 is removably attached to the most remote accessory section 130, and conduit 52 is directed into a bucket 132 of suitable capacity, e.g. five gallons. After rinsing chute sections 126, 128, and 130 and collecting the water and residue in bucket 132, the bucket is emptied into tank 44 through neck 96.

If separation of the larger aggregate is desired, bucket 98 is placed in neck 96 and preferably remains in the neck throughout the washing and collection process, but especially when the chute sections are cleaned. After collection, the bucket is removed and the captured aggregate is added to the drum of otherwise disposed of. Other concrete dispensing, shaping, and handling components such as trowels, hoes, and shovels can be cleaned with water in bucket 132, with the bucket again emptied into the tank. Thus, all of the concrete wash product is contained in tank 44.

Once the concrete wash product is collected, it can be returned to the mixing drum for eventual reuse as part of the next batch of concrete. The initial recycling step is to raise booster axle frame 30, which carries tank 44 to the dispensing position behind the opening in mixing drum 22. This raises tank 44, and more particularly passage 112, to a height sufficient for transferring the contents of the tank into mixing drum 22 by gravity. With tank 44 in the dispensing position, valve handle 116 is used to open the valve and allow the water and residue, i.e. the concrete wash product, to flow by gravity into the drum. Alternatively, if tank 44 is equipped with the flow control mechanism described below in connection with FIGS. 10 and 11, the hose is opened to drain the tank.

After the container is emptied, vehicle 16 returns to the concrete plant for another load. Depending on the amount of water collected and returned to mixing drum 22, there may be a need to adjust the amount of water supplied to the drum at the concrete plant to preserve the ratio or proportion of water to the other components of the mix. In other words, the amount of water used to wash various components at the construction site is taken into account when determining the amount of water to load into the drum at the concrete plant.

One suitable approach, shown in FIG. 5, is an elongate transparent or translucent tube 134 mounted to an end wall 136 of tank 44 in fluid communication with the tank interior. Water and dissolved or suspended residue flow into the tube, to a level matching the level inside the tank. Indicia are provided along the tube to indicate volumetric readings associated with different levels along the tube. Thus, the operator can visually determine the volume of concrete wash product in tank 44. Upon return of the vehicle to the concrete plant, the volume reading is taken into account and the amount of water added to the mix is adjusted accordingly.

FIGS. 8 and 9 illustrate an alternative embodiment container 138 suitable for mounting between frame arms 34 and 36 of the booster axle assembly, to be moved between collection and dispensing positions by pivoting the booster axle frame as before. In contrast to tank 44, container 138 is fixed to the frame arms, so that it rotates approximately 90 degrees from a collecting position shown in FIG. 8 to a dispensing orientation shown in FIG. 9. In lieu of separate intake and outlet passages, container 138 includes a single passage having a neck 140 extending radially away from the container and having a cylindrical shape similar to neck 96.

The fixed mounting of container 138 entails increased stability. However, this arrangement also entails reduced capacity as compared to a container on the order of tank 44 having the same volume.

FIGS. 10 and 11 illustrate a flow control device used in lieu of valve 114 to alternatively open and close outlet passage 112. FIG. 10 depicts a view similar to FIG. 6, taken from the opposite side of vehicle 16. In this approach, the outlet passage includes a substantially rigid cylindrical neck 142 extended away from bottom region 106, and a self-supporting but flexible hose 144 secured about neck 142 with a hose clamp 146. A cable 148 is wrapped about the free end of hose 144 and secured by a cable clamp 150. The cable extends on an upward incline through a cable bracket 152. A handle 154 is disposed at the free end of the cable, and a stop 156 is located along a medial region of the cable.

Bracket 152 is shown in more detail in FIG. 11. The bracket is substantially planar and rectangular. An opening 158 through the bracket includes a vertical slot 160 and an enlarged circular region 162 at the top of the slot. The circular region is large enough to allow passage of stop 156 therethrough, while slot 160 permits passage of cable 144 but not the stop 156.

FIG. 10 shows the hose and cable in an "open passage" position with stop 156 and handle 154 on opposite sides of the bracket. To close passage 112, the user pulls handle 154 to draw the cable upwardly and to the right as viewed in the figure, until stop 156 has passed through the circular portion of opening 158. This draws the free end of hose 144 upward, bending the hose to form a crease between clamps 146 and 150. At this point, the operator secures the cable by shifting stop 156 downwardly while keeping the stop to the right of bracket 152 as viewed in FIG. 10. The stop abuts the bracket along slot 160, maintaining the hose in the closed position to prevent the flow of liquid out of tank 44.

To drain the concrete wash product into drum 22, the booster axle frame is raised as before, and then stop 156 is released from the bracket to allow the cable and hose to return to the open position. As compared to valve 114, the combination of hose 144 and cable 148 provides a less costly flow control mechanism.

Thus in accordance with the present invention, concrete wash product is recovered and reused, with a container positionable for wash product collecting, wash product dispensing, and vehicle transit without requiring manual intervention by the operator. Consequently, concrete wash product can be handled in an environmentally sound manner with no significant increase in the time and labor involved, and with a cost savings due to the reuse of previously wasted water and concrete residue. The recovery system is particularly cost effective in vehicles having booster axle assemblies, because the required support and guidance of the container are provided by the booster axle frame.

What is claimed is:

1. A device for collecting and recycling concrete wash product, including:

an elongate container adapted to receive and hold concrete wash product; and a mounting arrangement for securing the container to a booster axle frame of a transit concrete mixing vehicle wherein the booster axle frame is coupled to pivot with respect to a chassis of the vehicle about a transverse pivot axis toward and away from a chassis supporting position in which wheels mounted rotatably to the frame about transverse wheel axes engage the ground to support the chassis through the frame, the mounting arrangement securing the container in a lengthwise and transverse extension between opposite side aims of the booster axle frame for carriage by the frame in transit as the vehicle travels between concrete production facilities and construction sites, and further securing the container for arcuate movement with respect to the chassis as the booster axle frame pivots, between a collecting position corresponding to a lowered frame in which the container is disposed below a discharge chute of the vehicle to enable a transfer of concrete wash product from the chute to the container by gravity, and a dispensing position corresponding to a raised booster axle frame in which the container is disposed near an opening of a mixing drum of the vehicle to enable a transfer of concrete wash product from the container to the mixing drum by gravity.

2. The device of claim 1 wherein:

the mounting arrangement is adapted to secure the container to pivot relative to the booster axle frame about an axis parallel to the transverse pivot axis and disposed above a center of mass of the container.

3. The device claim 2 further including:

an intake passage formed along a top region of the container.

4. The device of claim 3 further including:

a filtering component disposed along the intake passage adapted to prevent aggregate having diameters above a predetermined threshold from entering the container.

5. The device of claim 3 further including:

a receptacle adapted for removable mounting to a lower end of a discharge chute to receive concrete wash product generated as the chute is washed, and a conduit having a first end attached to the receptacle for conducting concrete wash product from the receptacle into the container through the intake passage.

6. The device of claim 3 further including:

an outlet passage open to a bottom region of the container, and a flow control mechanism for alternatively opening and closing the outlet passage.

7. The device of claim 6 wherein:

the outlet passage comprises a conduit adapted to conduct concrete wash product from the container into a mixing drum.

8. The device of claim 1 further including:

a means for measuring an amount of concrete wash residue collected in the container.

9. The device of claim 1 wherein:

the booster axle frame, when lowered, supports the container in suspension above the ground.

10. The device of claim 1 wherein:

the transit concrete mixing vehicle comprises a hopper disposed adjacent said opening of the mixing drum to facilitate loading material into the drum; and the container when in the dispensing position further is disposed below the hopper.

* * * * *